US006286352B1

(12) United States Patent
Hackstock

(10) Patent No.: US 6,286,352 B1
(45) Date of Patent: Sep. 11, 2001

(54) STRETCH ROLL FORMING APPARATUS USING FRUSTO-CONICAL ROLLS

(75) Inventor: Gerald Hackstock, Clay Township, MI (US)

(73) Assignee: Pullman Industries, Inc., Troy, MI (US)

( * ) Notice: Subject to any disclaimer, the term of this patent is extended or adjusted under 35 U.S.C. 154(b) by 0 days.

(21) Appl. No.: 09/453,743

(22) Filed: Dec. 2, 1999

Related U.S. Application Data

(60) Provisional application No. 60/110,735, filed on Dec. 3, 1998.

(51) Int. Cl.[7] ..... B21D 11/08
(52) U.S. Cl. ..... 72/167
(58) Field of Search ..... 72/167, 168, 177, 72/377

(56) References Cited

U.S. PATENT DOCUMENTS

| | | | | |
|---|---|---|---|---|
| 2,190,429 | * | 2/1940 | Kellogg | 72/167 |
| 2,884,987 | | 5/1959 | Shaw, Jr. | 153/45 |
| 3,339,392 | * | 9/1967 | Buckwalter | 72/167 |
| 5,188,418 | | 2/1993 | Walworth, Jr. et al. | 296/183 |
| 5,544,932 | | 8/1996 | Walworth, Jr. et al. | 296/183 |
| 5,575,525 | | 11/1996 | Walworth, Jr. et al. | 296/183 |
| 5,588,322 | | 12/1996 | Passone | 72/383 |
| 5,979,205 | * | 11/1999 | Uchida | 72/167 |

FOREIGN PATENT DOCUMENTS

| | | | | |
|---|---|---|---|---|
| 211293 | * | 7/1984 | (DD) | 72/167 |
| 947696 | * | 8/1956 | (DE) | 72/167 |
| 992363 | * | 10/1951 | (FR) | 72/167 |
| 46-6346 | * | 2/1971 | (JP) | 72/167 |
| 1-154806 | * | 6/1989 | (JP) | 72/167 |
| 613839 | * | 7/1967 | (SU) | 72/167 |
| 387764 | | 6/1973 | (SU) | 72/167 |
| 1764742 | * | 9/1992 | (SU) | 72/167 |

* cited by examiner

*Primary Examiner*—Daniel C. Crane
(74) *Attorney, Agent, or Firm*—Gifford, Krass, Groh, Sprinkle, Anderson & Citkowski, P.C.

(57) ABSTRACT

A stretch roll forming apparatus has multiple roll forming stations arranged serially so that a sheet metal workpiece can be advanced through the stations in sequence. Each station includes a pair of roller dies supported by an inboard support station and by an outboard support station, in spaced apart relationship, so that the roller dies are each rotatable about a horizontal axis. The roller dies are configured to shape a sheet metal workpiece which is advanced between them. At least one of the roll forming work stations is a stretch roll forming work station. In this station, the roller dies each have a frusto-concial shape. The roller dies are positioned such that the taper of one extends from the inboard support to the outboard support while the taper of the other extends from the outboard support to the inboard support. When a sheet metal workpiece is advanced between the roller dies of the stretch roll forming station, one longitudinal edge of the workpiece is stretched relative to the other longitudinal edge. This gives the workpiece a longitudinal curvature.

7 Claims, 5 Drawing Sheets

STRETCH ROLL FORMING APPARATUS USING FRUSTO-CONICAL ROLLS

RELATED APPLICATION

This patent application claims priority of Provisional Patent Application 60/110,735 filed Dec. 3, 1998.

FIELD OF THE INVENTION

The present invention relates to a method and apparatus for stretch roll forming. More particularly, the present invention provides a method and apparatus for producing a roll formed shape which is curved along its length.

BACKGROUND OF THE INVENTION

Generally, automotive body panels are formed from metal sheet using various forming methods to create the desired shape. For example, to form a roof header for a truck cab, processes such as contour roll forming and stretch forming may be used. Two separate processes are generally required because the profile of a roof header has a compound angle and a non-uniform cross section that cannot be formed by a single operation.

Contour roll forming is one process used to form metal sheet into a desired shape. Contour roll forming is a cold rolling process in which an elongated metal sheet is fed through a series of longitudinally aligned roll stations to progressively shape of sheet. Contour roll forming may be used for symmetrical and asymmetrical shapes of uniform cross section.

A typical roll forming station includes a set of roller dies which are contoured for forming the metal sheet into the desired shape. The roller dies are set opposite each other along a parallel axis, for creating the upper and lower profile of the metal sheet. The roller dies may be positioned side by side or above and below each other depending on the shape forming requirements.

Roll forming produces lengths of material having a constant crosssection; however, many articles, such as roof headers for pickup trucks, require an additional longitudinal curvature. Therefore, the roll formed stock must then be stretched in a separate operation to create a curved outer edge resulting in a non-uniform cross section. In stretch forming, the metal sheet is positioned over a form block or mating dies having the desired profile. The sheet is then held in tension and stretched beyond its yield point, causing the metal to take the desired shape. Unlike contour roll forming, stretch forming may be used to create shapes with compound curves, twists and bends in multiple planes. A bending machine including a form block having adjustable grippers on either side is generally used to form a parabolic curve along the outer edge of the roll formed stock. Alternatively, the metal sheet may be placed between upper and lower dies and the parabolic curve formed with the mating dies. Adjustable grippers on either edge of the dies hold the metal sheet in place and stretches the material between the dies.

A disadvantage of this manufacturing process is that it involves two forming steps, there by requiring a multiplicity of machinery and abundance of time. Each forming method requires its own specific machinery in addition to the auxiliary equipment required for production operation. Stretch forming using a bending machine has the further disadvantage that is slow and not well suited to high volume production. Also, stretch forming requires extra metal sheet to allow for gripping the work piece during the forming process. Additional material must also be provided because of the possibility of spring back after the stretch forming process.

Clearly, it is desirable to consolidate or eliminate the requirement of using separate roll forming and stretching operations in the manufacture of complexly contoured articles such as truck roof headers. However, it has not heretofore been possible to roll form sheet metal while simultaneously stretching the sheet metal to introduce a longitudinal curvature in the plane of the sheet. As will be detailed hereinbelow, the present invention provides a novel roll forming process which also stretches a workpiece.

SUMMARY OF THE INVENTION

According to the present invention a stretch roll forming apparatus is provided that includes a plurality of roll forming stations. The roll forming stations are serially disposed so that a sheet metal workpiece may be advanced through each of the stations in sequence. Each station includes a pair of roller dies supported by an inboard support station and an outboard station, in a spaced apart relationship, so as to each be rotatable about a horizontal axis. The roller dies are configured to shape a sheet metal workpiece which is advanced therebetween. At least one of the roll forming stations comprises a stretch roll forming station wherein the roller dies each have a frusto-conical shape. The roller dies are disposed so that the taper of one of the roller dies extends from the inboard support to the outboard support, while the taper of the other die extends from the outboard support to the inboard support. When a sheet metal workpiece is advanced between the roller dies of the stretch roll forming work station, a first longitudinal edge of the workpiece is stretched relative to a second longitudinal edge such that a longitudinal curvature is imposed on the workpiece.

In some embodiments of the present invention, one of the roll forming stations is a stretch roll forming station while the other stations are non-stretch roll forming stations. The stretch roll forming station may be the final roll forming station or one or more non-stretch roll forming stations may be positioned after the stretch roll forming station. In other embodiments of the present invention a sweep station is provided which is operative to impose a curvature on the sheet metal workpiece out its original plane. The sweep station may be provided downstream of the roll forming stations.

DETAILED DESCRIPTION

The present invention overcomes the disadvantages of the prior art by providing a roll forming station that also stretch forms a workpiece thereby eliminating a step in the metal sheet forming process. The implementation of an additional roll station to perform the stretch forming eliminates the need for additional stretch forming equipment while decreasing production time. Deletion of the separate stretch forming process also eliminates the scrap metal sheet resulting from the need to grip the metal while forming the curvature about a form block.

Figure 1:
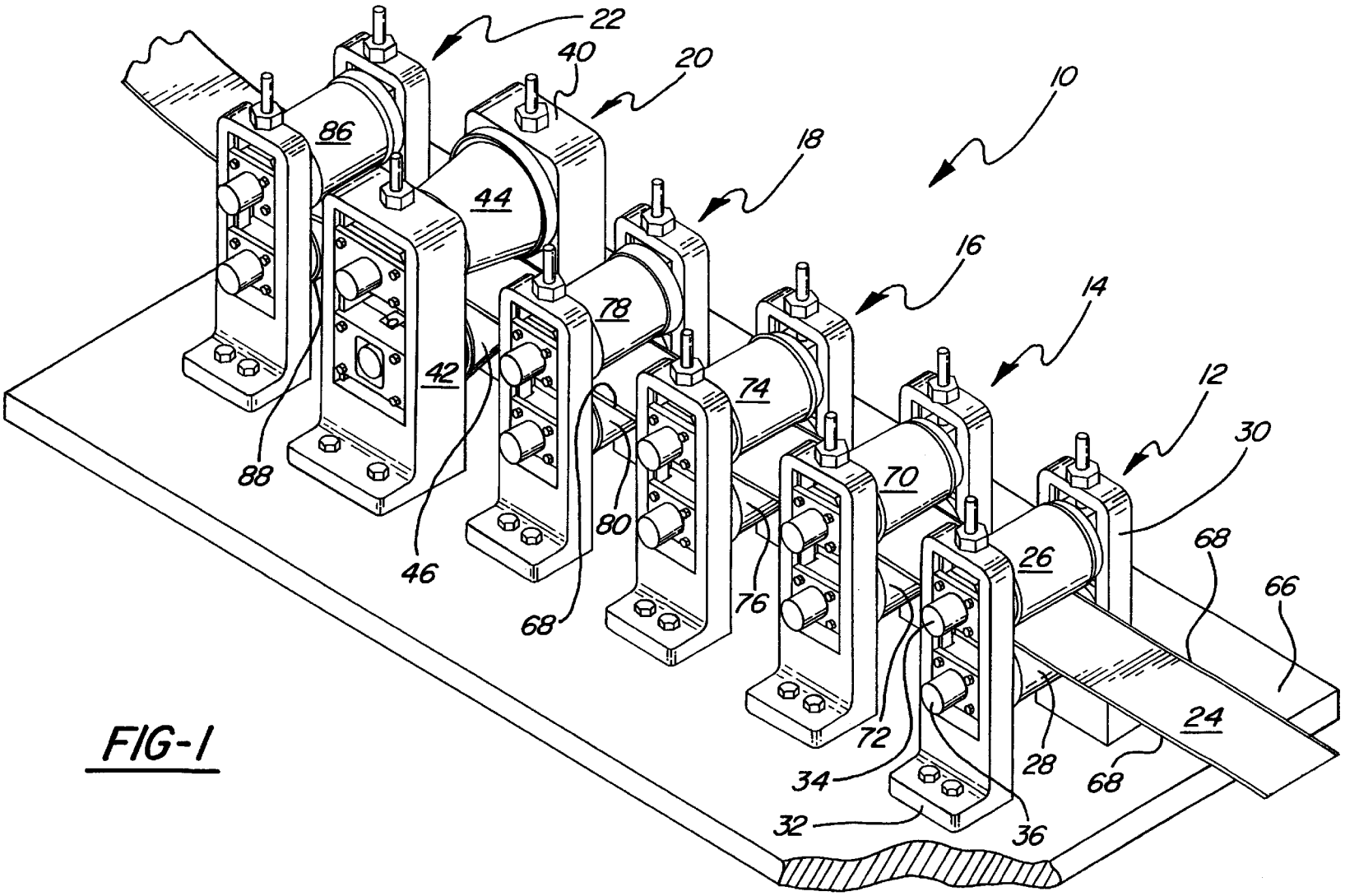
FIG. 1 is a perspective view of a preferred embodiment of the present invention.

One embodiment of the roll forming method and apparatus of the present invention is depicted in FIG. 1 at 10, and comprises a series of six roll forming stations, specifically configured to produce a truck cab roof header, it being understood that the apparatus may be configured to produce other items. One of the stations performs the stretch roll forming method of the present invention and eliminates the need for stretch forming the roof header. A first roll forming station 12 is aligned in a series with three other roll forming stations 14, 16, 18. A stretch roll forming station 20 is provided after the first four roll forming stations 12, 14, 16, 18 and is aligned longitudinally with the stations. A final roll forming station 22 is aligned longitudinally with stretch roll forming station 20 and is placed in the longitudinal series of stations at the end of the contour roll forming process generally shown at 10.

In the preferred embodiment of the present invention, a truck cab roof header is formed by initially passing a metal sheet 24 longitudinally through a series of roll stations 12, 14, 16, 18, 20, 22. A typical roll station 12 is equipped with a set of roller dies 26, 28 for forming the shape of the metal sheet 24. Roller dies 26, 28 are set opposite each other along a parallel axis, creating the upper and lower profile of the metal sheet 24. Roller dies 26, 28 are supported in their horizontal position by inboard stand 30 and outboard stand 32. Typically, roll station 12 is referred to as a universal contour roll forming machine with outboard support for roll shafts 34, 36. Outboard stand 32 can be adjusted horizontally by sliding it inwardly toward the inboard stand 30 or it may be removed to change roll shafts 34, 36 by sliding it outwardly away from inboard stand 30. Outboard stand 32 may also be adjusted vertically by an adjusting screw (not shown) on top of the stand. Alternatively, adjustment may be accomplished by the use of shims or the like. Such non-stretch, roll forming stations are known in the prior art. Roll stations 14, 16, 18 and 22 are also universal contour roll forming machines with outboard support for roll shafts as described above.

Figure 2:
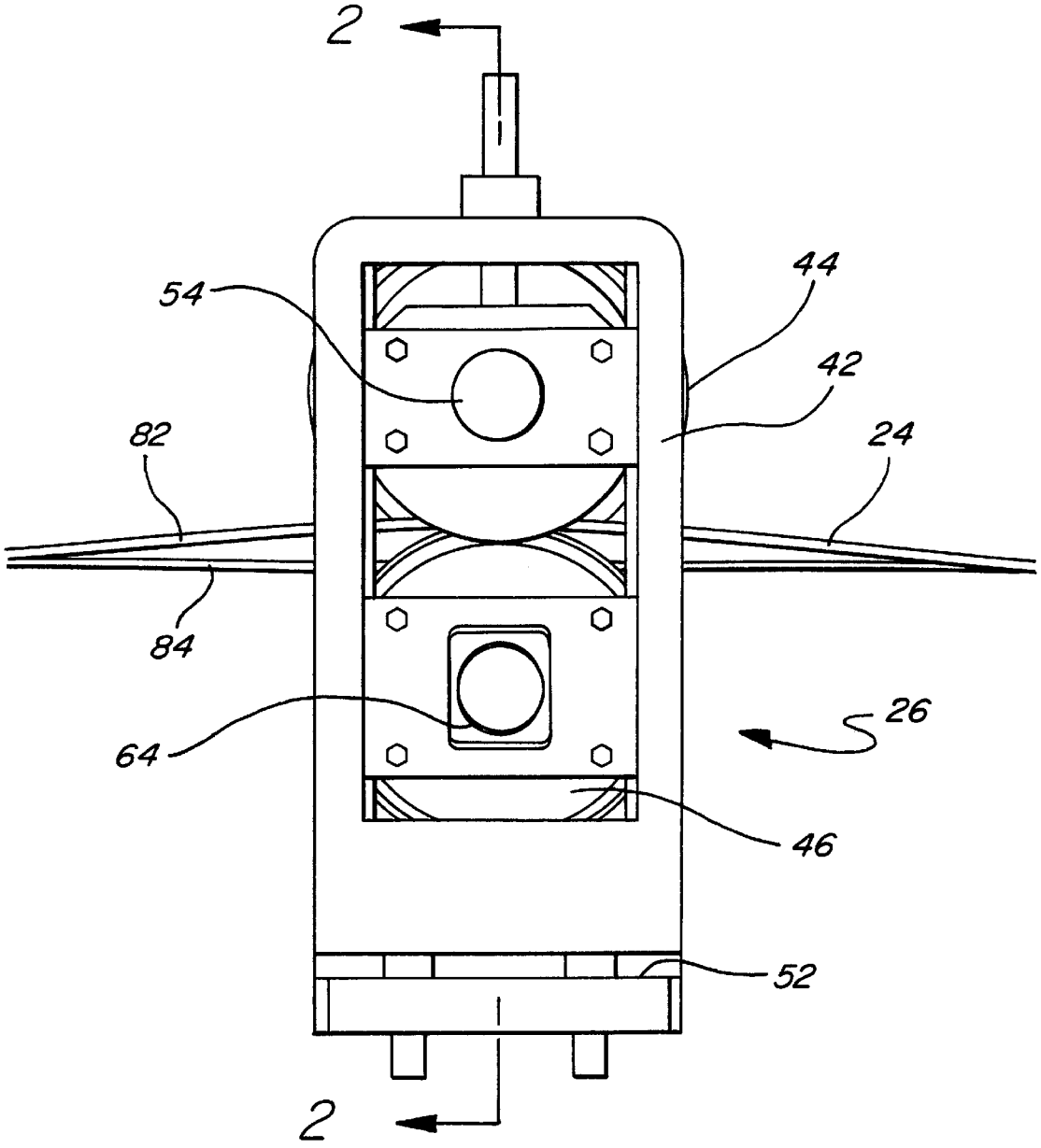
FIG. 2 is a side view of the stretch forming roll station of the present invention.

The stretch roll forming station 20 of the present invention is similarly designed as a universal contour roll forming machine having outboard support for roll shafts. As shown in FIGS. 1 and 2, stretch roll forming station 20 includes an inboard stand 40 and an outboard stand 42. Contoured roll dies 44 and 46 each have a frusto-conical shape, rather than the cylindrical shape of non-stretch forming roll dies 26, 28, and perform the stretch roll forming process of the present invention.

Figure 3:
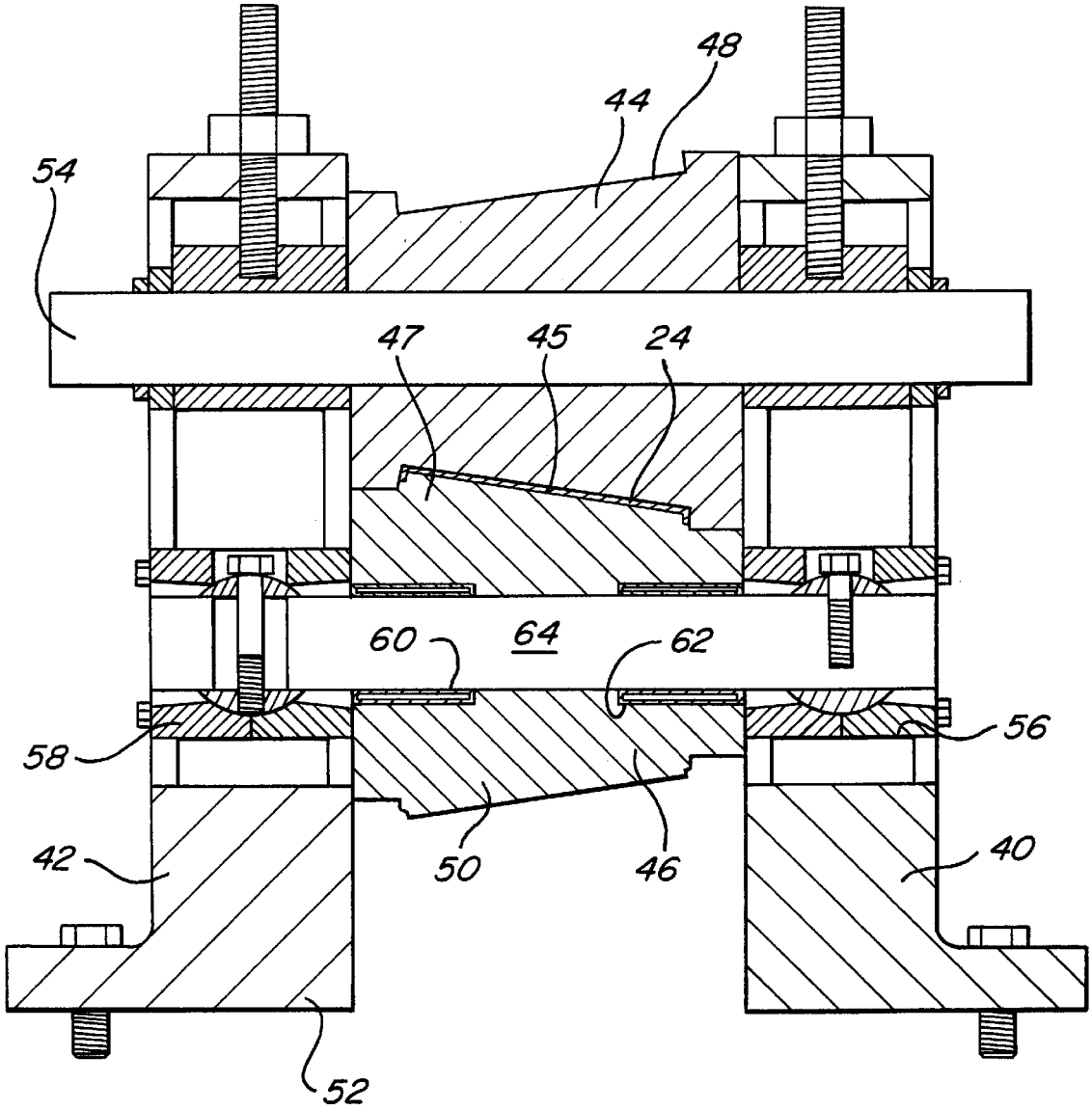
FIG. 3 is a cross-sectional view of the stretch forming roll station depicted in FIG. 2 taken along Lines 2—2.

As best shown in FIG. 3, frusto-conical roll dies 44, 46 oppose each other and are supported in a horizontal plane by inboard stand 40 and outboard stand 42. Upper roll die 44 preferably has the frustum 48 extending from inboard stand 40 toward outboard stand 42. Lower roll 46 preferably has frustum 50 extending from outboard stand 42 toward inboard stand 40. Metal sheet 24 is then stretched roll formed between upper roll 44 and lower roll 46. The circumference of opposed portions of the two tapered roller dies 46, 48 differ, and when the web of workpiece material is advanced therebetween, the rollers 46, 48 differentially stretch the material across its width. This differential stretching curves the workpiece along its length. The curvature is in the plane of the workpiece. As shown in FIG. 3, the lower roll 46 preferably has a raised central portion which acts as a forming ridge 47. The upper roll 44 has a corresponding lowered central portion which acts as a forming groove 45. Obviously, the groove 45 and ridge 47 may take other shapes depending on the application.

With reference now to outboard stand 42, like roll station 12, adjusting screws, shims or the like (not shown) may be provided under base 52 to adjust outboard stand 42 along a vertical plane. While the upper roll 48 is stationary about roll shaft 54, the lower roll 46 is supported by a stationary ball joint assembly 56 within inboard stand 40 and an adjustable ball joint assembly 58 within outboard stand 42. Lower roll 46 is completely adjustable about the horizontal and vertical plane of travel of metal sheet 24 by adjustable ball joint assembly 58. Roller bearing assemblies 60, 62 are typically provided about roll shaft 64 for rotation of lower roll 46.

With reference to FIGS. 1 and 2, the preferred process of the present invention is illustrated in the context of the forming of metal sheet 24 into a truck cab roof header by longitudinally passing metal sheet 24 through the series of six roll stations. Initially, metal sheet 24 is fed through first roll station 12 having a first set of contoured roll dies 26, 28. Metal sheet 24 is bent 22½° at either end 66, 68 along a horizontal plane. Metal sheet 24 continues toward roll station 14 where contoured roll dies 70, 72 continue to shape metal sheet 24 by additionally bending either end 66, 68 by 22½° for a total bend of 45° Metal sheet 24 continues through roll stations 16 and 18 where contoured roll dies 74, 76 and 78, 80 continue bending ends 66, 68 an additional 22½°, respectively, to create a full 90° bend before passing through stretch roll forming station 40. It is to be understood that the number of stations and the angle of bending achieved in each may be varied, depending on the particular item being fabricated, as is known in the art; and the principles of the present invention can be adapted to any roll forming process.

Once each end 66, 68 of metal sheet 24 is bent 90°, metal sheet 24 is passed through stretch roll forming station 20. Opposing frusto-conical roll dies 44, 46 then shape an outer radial curvature within the horizontal plane of metal sheet 24. In the preferred embodiment, end 68 is stretched formed by frusto-conical roll dies 44, 46 so that metal sheet 24 has an outer radius 82 greater than inner radius 84 along end 66 (see FIG. 2).

Once metal sheet 24 has passed through the first four roll stations 12, 14, 16, 18 and stretch roll forming station 20, roll station 22 is provided to reshape the 90° bends formed along ends 66, 68 if necessary. Specifically, roll station 22 is provided with contoured roll dies 86, 88 having the same contour as roll dies 78, 80 provided in fourth roll station 18. Roll station 22 reshapes metal sheet 24 if necessary where the 90° bends may be deformed by stretch roll forming station 20.

Although not illustrated in FIG. 1, the roll forming system may also include a sweep stand disposed downstream of the last roll station 22. As is known in the art, a sweep stand, also referred to as a sweep head, operates to impose a further curvature on the workpiece passing therethrough. In the illustrated embodiment, as depicted for the formation of a truck cab roof header, the sweep stand curves the stretch and roll formed workpiece in a direction generally perpendicular to the longitudinal curvature imposed by the stretch roll forming stand 40. This curvature is in a direction generally perpendicular to the planar surface of the workpiece.

Figure 4:
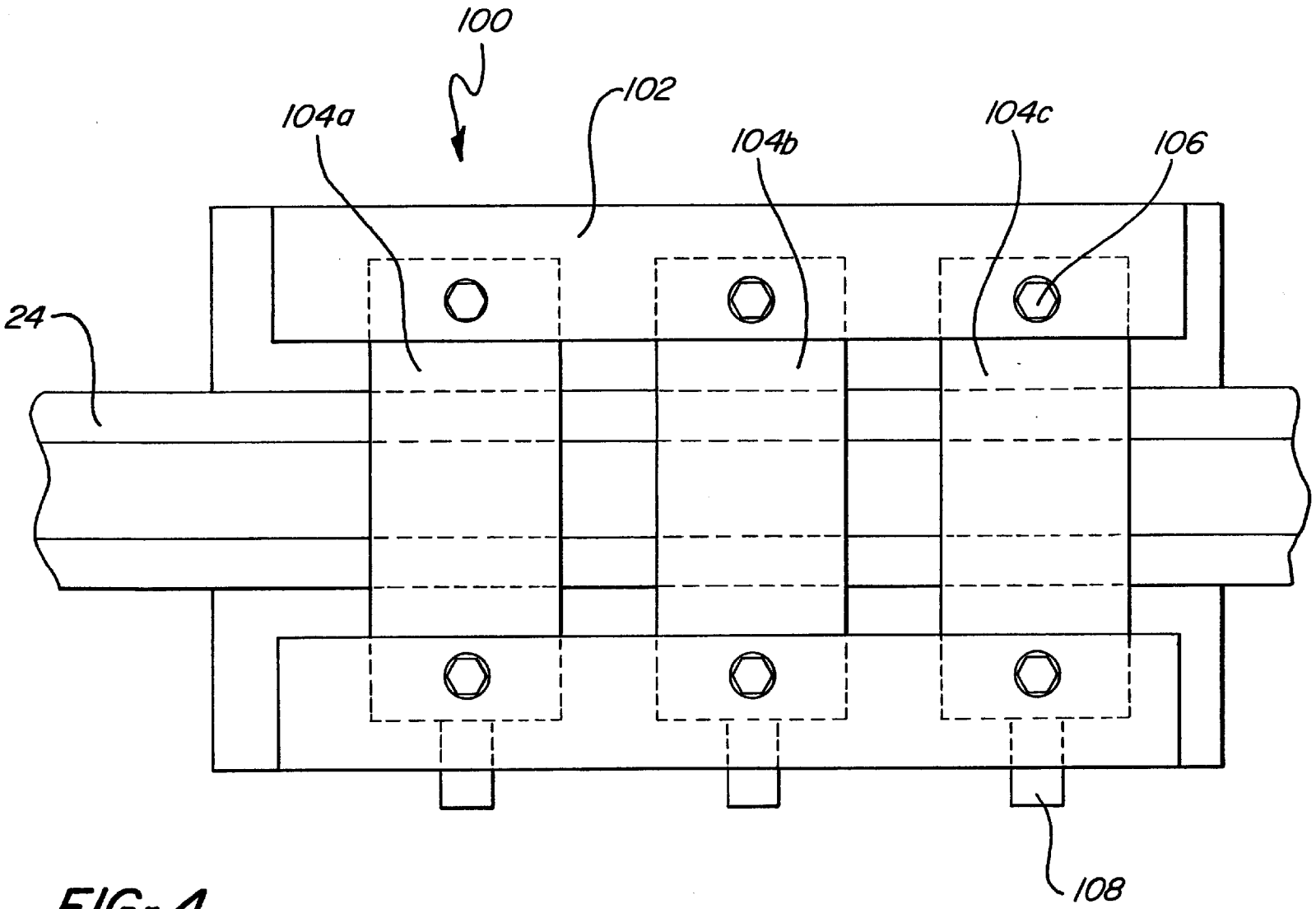
FIG. 4 is a top plan view of a sweep station which may be utilized in conjunction with the present invention.
Figure 5A:
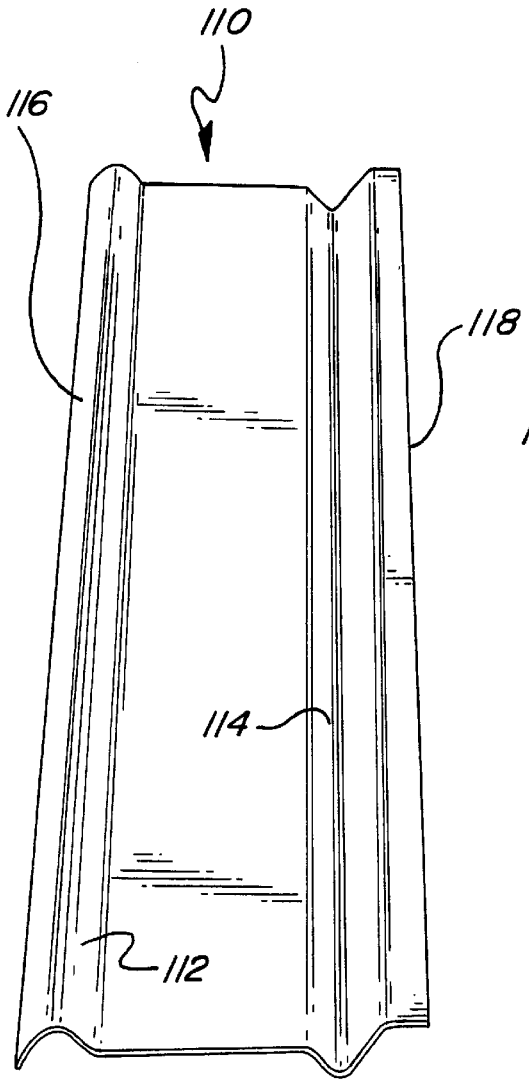
FIG. 5A is a perspective view of a roll formed workpiece which has not been stretched.
Figure 5B:
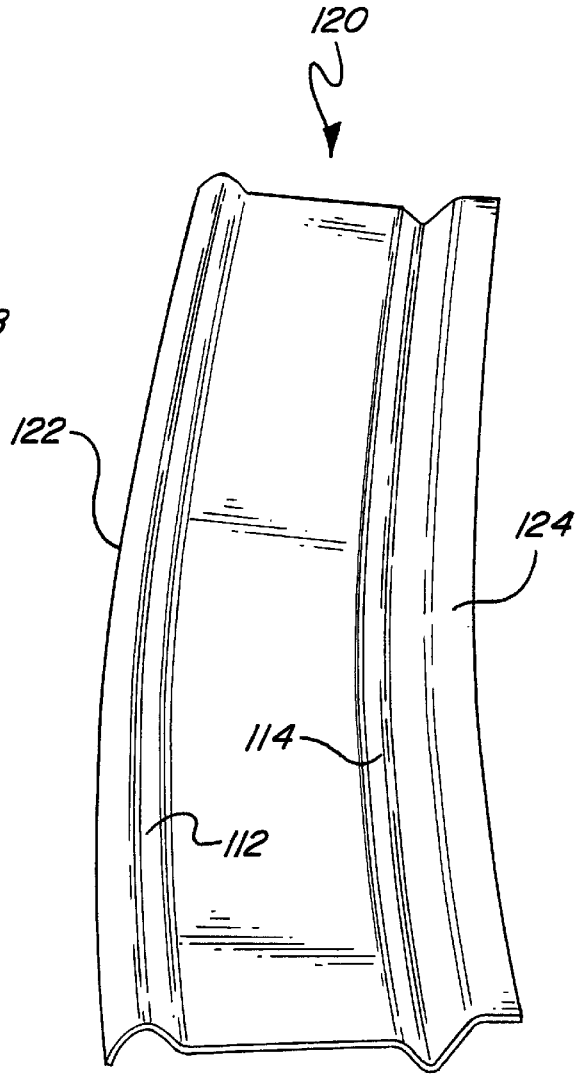
FIG. 5B is a perspective view of a roll formed workpiece which has been stretched through the use of the present invention so as to provide a longitudinal curvature thereto.

Sweep stands are well known in the art, and FIG. 4 is a top plan view of a sweep station which may be utilized in the present invention. As illustrated, the sweep head 100 is operative to receive the roll formed web 24, and to impose a curvature on that web in a direction generally perpendicular to the illustration. The sweep head includes a support frame 102 which may be further mounted on a support stand (not illustrated) generally similar to the support stands used for the roll forming stations. The support frame 102 retains at least one set of sweep forming dies. Each die set includes an upper and a lower die member, and these dies have a profile generally corresponding to the roll formed profile of the web 24. The illustrated embodiment 100 includes three of such die sets, 104*a*, 104*b*, 104*c*. The illustration only the top member of each die set is shown, it is understood that the bottom members are generally similar and aligned therewith; however, there is a slight offset between the top and bottom members of each die set, and it is this offset which produces the sweep curvature. Preferably, the members of the die set are formed from hard bronze material, and one preferred material is an alloy sold under the designation Ampco® 21. Adjustment screws, for example screws 106 and 108, permit adjustment of the dies relative to one another. The sweep station is an optional component of the systems of the present invention, and may be eliminated or otherwise configured depending on the particular items being fabricated, Various characteristics of workpieces fabricated in accord with the present invention are better explained by reference to FIGS. 5A and 5B. FIG. 5A is a perspective view of a roll formed workpiece 110 which has not been subjected to the stretch roll forming process of the present invention. The workpiece 110 is a generally planar body of sheet metal having a first contoured ridge 112 projecting upwards from the plane of the workpiece and a second contoured ridge 114 projecting downward therefrom. The two ridges 112, 114 are generally parallel to one another, and run the entire length of the roll formed workpiece 110. The two edges 116, 118 of the workpiece 1 10 are straight and generally parallel to one another; although it is to be understood that in some roll forming processes, edges are distorted and hence non-parallel. FIG. 5B depicts a workpiece 120 which is generally similar to the workpiece 110 of FIG. 5A in its contour, but which has been subjected to a stretch roll forming process according to the present invention, and hence is curved along its length. The workpiece 120 of FIG. 5B has a cross-section with ridges 112, 114 generally similar to those in FIG. 5A; however, the edges 122, 124 are both curved along their lengths, in a plane corresponding generally to the plane of the workpiece 120. It is to be understood that workpiece 120 is not entirely planar, since it includes curved features; however, in the context of this disclosure, the plane of the workpiece is understood to be the plane which was defined by the sheet of workpiece material prior to its deformation in the roll forming process. Although not shown in FIG. 5B, the workpiece may be further curved in a direction generally perpendicular to the plane of the workpiece through the use of a sweep station as discussed above.

Although the present example describes roll forming of metal sheet 24 having symmetrical bends of 90° along ends 66, 68, stretch roll forming through roll form station 20 may also be performed on asymmetrical profiles. Also, while this invention has been described in connection with the fabrication of a header element for a vehicle roof, it may be used in conjunction with the roll forming of other members.

A significant advantage of the present invention is the elimination of the separate stretch forming process to create the desired profile of metal sheet 24. Elimination of the separate stretch forming process cuts down on cost and scrap metal while simultaneously increasing production. The ability to feed metal sheet 24 continuously through a series of roll stations while simultaneously bending and stretch forming metal sheet to its desired profile is novel to the art, eliminates multiple machinery, decreases production time and also eliminates scrap. Thus, the present invention provides a simple and easy way to form a metal sheet into a symmetrical or asymmetrical radially curved profile.

Having described the various embodiments of the present invention with reference to the accompanying figures, it will be appreciated that various changes and modifications can be made without departing from the scope or spirit of the invention.

I claim:

1. A stretch roll forming apparatus comprising a plurality of roll forming stations, said roll forming stations being serially disposed so that a sheet metal workpiece can be advanced through each of said stations in sequence; each station including a pair of roller dies supported by an inboard support station and by an outboard support station, in a spaced apart relationship, so as to each be rotatable about a horizontal axis, said roller dies being configured to shape a sheet metal workpiece which is advanced therebetween;

at least one of said roll forming stations comprising a stretch roll forming station wherein said roller dies each have a frusto-conical shape, said roller dies being disposed so that the taper of a first one of said roller dies extends from the inboard support to the outboard support, and so that the second of said roller dies is disposed so that its taper extends from the outboard support to the inboard support; whereby a sheet metal workpiece which is advanced between said roller dies of said stretch roll forming station has a first longitudinal edge thereof stretched relative to a second longitudinal edge thereof, so as to impose a longitudinal curvature thereupon; and a sweep station which is operative to impose a curvature on said sheet metal workpiece in a horizontal plane which is perpendicular to said longitudinal curvature; whereby said stretch roll forming apparatus is operative to impose curvatures on said sheet metal workpiece in two planes which are perpendicular to one another.

2. The stretch roll forming apparatus of claim 1, further including means for adjusting the position of at least one of said roller dies along a horizontal plane and a vertical plane.

3. The stretch roll forming apparatus of claim 1, further including means for adjusting the position of at least one of said roll forming stations along a horizontal plane and a vertical plane.

4. The stretch roll forming apparatus of claim 1, wherein at least one of said roll forming stations is a non-stretch roll forming station.

5. The stretch roll forming apparatus of claim 1, comprising at least one non-stretch roll forming station disposed upstream of a stretch roll forming station.

6. The stretch roll forming apparatus of claim 5, further including a non-stretch roll forming station disposed downstream of said stretch roll forming station.

7. The stretch roll forming apparatus of claim 1, wherein said sweep station is downstream of all of said roll forming stations.

* * * * *